US009590293B2

(12) United States Patent
Bevelacqua

(10) Patent No.: US 9,590,293 B2
(45) Date of Patent: Mar. 7, 2017

(54) GPS/WIFI BATTERY ANTENNA

(71) Applicant: Google Inc., Mountain View, CA (US)

(72) Inventor: Peter Bevelacqua, Mountain View, CA (US)

(73) Assignee: Google Inc., Mountain View, CA (US)

( * ) Notice: Subject to any disclaimer, the term of this patent is extended or adjusted under 35 U.S.C. 154(b) by 199 days.

(21) Appl. No.: 14/487,370

(22) Filed: Sep. 16, 2014

(65) Prior Publication Data

US 2016/0079660 A1 Mar. 17, 2016

(51) Int. Cl.

| | |
|---|---|
| ***H01Q 1/12*** | (2006.01) |
| ***H01Q 1/27*** | (2006.01) |
| ***H01Q 1/38*** | (2006.01) |
| ***H01Q 1/44*** | (2006.01) |
| ***H01Q 9/06*** | (2006.01) |

(52) U.S. Cl.

CPC ..... *H01Q 1/273* (2013.01); *H01Q 1/38* (2013.01); *H01Q 1/44* (2013.01); *H01Q 9/065* (2013.01)

(58) Field of Classification Search

CPC ..... H01Q 1/243; H01Q 1/273; H01Q 1/241; H01Q 9/16

USPC ..... 343/718, 702, 793

See application file for complete search history.

(56) References Cited

U.S. PATENT DOCUMENTS

| | | | | |
|---|---|---|---|---|
| 4,471,493 | A | 9/1984 | Schober | |
| 6,492,957 | B2 * | 12/2002 | Carillo, Jr. | H01Q 1/245 250/336.1 |
| 7,271,779 | B2 | 9/2007 | Hertel | |
| 7,649,463 | B2 | 1/2010 | Tuttle | |
| 2009/0202087 | A1 | 8/2009 | Nakashima et al. | |
| 2013/0187789 | A1 * | 7/2013 | Lowe | G08C 19/16 340/870.02 |
| 2013/0194141 | A1 | 8/2013 | Okajima et al. | |
| 2013/0201440 | A1 | 8/2013 | Howell et al. | |
| 2014/0187179 | A1 * | 7/2014 | Ferguson | H01Q 3/24 455/77 |

FOREIGN PATENT DOCUMENTS

WO 2005024997 A1 3/2005

OTHER PUBLICATIONS

International Search Report and Written Opinion for PCT Application No. PCT/US2015/050141 dated Dec. 30, 2015.

* cited by examiner

*Primary Examiner* — Hoanganh Le
(74) *Attorney, Agent, or Firm* — Lerner, David, Littenberg, Krumholz & Mentlik, LLP

(57) ABSTRACT

A dipole antenna assembly for an electronic device includes a rear mount having electronic components exposed at one of its surfaces, an antenna, a printed circuit board, and a battery. The antenna may be adjacent the rear flexible mount. The antenna includes a first portion and a second portion. The second portion comprises a transmission line. The printed circuit board can be connected to the antenna and the battery can be connected to a portion of the rear flexible mount and the printed circuit board. A positive arm of the dipole antenna assembly can include the battery, and a negative arm of the dipole antenna assembly can include the outside surface of the transmission line.

19 Claims, 9 Drawing Sheets

GPS/WIFI BATTERY ANTENNA

BACKGROUND

The present application relates to dipole antenna assemblies provided within client computing devices.

Client computing devices communicate wirelessly with a network by means of an antenna. As client computing devices become smaller and more compact, the area that is available for antennas also decreases. Improvements are continually needed to provide an antenna capable of adequately receiving and transmitting information to and from a network within a compact space.

BRIEF SUMMARY

The present disclosure is directed to antennas for compact electronic devices and, more specifically, dipole antennas capable of covering a wide variety of bands, including, without limitation, GPS, WiFi, and cellular bands. In one example, a dipole antenna assembly can be formed from the architecture and structure of the pre-existing components of a head-mounted device. This configuration allows the overall aesthetic appeal and industrial design of the head-mounted device to remain the same, without the need to modify the design to create additional space within the head-mounted device for the antenna.

According to one aspect of the disclosure, a dipole antenna assembly for an electronic device includes a rear mount, an antenna adjacent the rear mount, a printed circuit board, and a battery. The rear mount has electronic components exposed at a surface thereof. The antenna may be adjacent the rear mount and may include a first portion and a second portion that includes a transmission line. The printed circuit board is attached to the antenna and the battery may be connected to a portion of the rear mount and the printed circuit board. A positive arm of the dipole antenna assembly comprises the battery, and a negative arm of the dipole antenna assembly comprises the transmission line.

In another example of this aspect, the assembly may further include a dipole splitting region separating the positive side and the negative side of the dipole antenna assembly. The dipole splitting region may further comprise a plurality of chokes to inhibit a flow of RF current between the positive side and the negative side of the dipole antenna assembly as a low frequency current passes through the dipole splitting region. At least one of the chokes may include either an inductor or a resistor.

In another example of this aspect, the electronic components may further include at least one of the following: a magnetometer, a microphone, a speaker, a power button, a light emitting diode, signal lines for the fuel gauge, and a battery ID resistor.

In another example of this aspect, the electronic device is a head-mounted device. The head-mounted device may further include a central eyeglass frame, a first side arm, and a second side arm. The first side arm may extend away from a first end of the central eyeglass frame, as well as house an optics display for displaying images to a user. The second side arm extends away from an opposed second end of the central eyeglass frame. The dipole antenna assembly can be positioned within the head-mounted device. In one example, the dipole antenna assembly can be positioned within the first side arm of the head-mounted device.

In another example of this aspect, the antenna is attached to the battery. The antenna and rear mount may also be flexible. The negative arm can further include the printed circuit board.

In accordance with another aspect of the disclosure, a dipole antenna assembly for an electronic device includes an antenna, a battery, a printed circuit board, and chokes. The antenna may have a first portion and a second portion. The battery may be joined to the first portion and the printed circuit board may be joined to the second portion. The chokes may be constructed and arranged to impede a flow of RF current within the dipole antenna assembly, wherein the flow of RF current flows across an area of the dipole antenna assembly extending between the battery and printed circuit board.

In one example of this aspect, the dipole antenna assembly covers a range of frequencies, the range of frequencies selected from at least one of the following: (a) 1575-1605 MHz; (b) 2400-2484 MHz; and (c) 5150-5850 MHz.

In still another example of this aspect, the antenna may be an elongated and flexible metallic element. The second portion of the antenna may comprise a transmission line.

In another example of this aspect, a positive dipole may be formed from the first portion of the antenna and the battery, and a negative dipole is formed from the exterior surface of the second portion. The negative dipole can also further include a rear component that supports the flexible antenna.

In one example of this aspect, the battery may form a positive dipole, the second portion of the antenna and the printed circuit board may form a negative dipole, and a split region separates the positive dipole from the negative dipole. The chokes may be positioned within the split region.

In another example of this aspect, the electronic device is a head-mounted device and further includes a central eyeglass frame and first and second side arms. The first side arm may extend away from a first end of the central eyeglass frame and house an optics display for displaying images to a user. A second side arm may extend away from an opposed second end of the central eyeglass frame, the dipole antenna assembly being positioned within the first side arm.

Another aspect of the disclosure is directed to a head-mounted device that incorporates a dipole antenna assembly. The head-mounted device may include a central eyeglass frame, first and second side arms, a display, and a dipole antenna assembly disposed within the head-mounted device. The first side arm may extend away from a first end of the central eyeglass frame. The display may be connected to the first side arm and provide images to a user. The dipole antenna assembly may be positioned within the first side arm. The dipole antenna assembly may further include a battery that forms a positive side of the dipole assembly. Another component of the head-mounted device may form a negative side of the dipole antenna assembly. An antenna may join the battery and the another component together. In one example, the another component is a printed circuit board.

In another example of this aspect, the dipole antenna assembly may further include a split region separating the positive side and the negative side of the dipole antenna assembly. Chokes may be positioned within the split region.

DETAILED DESCRIPTION

The aspects, features, and advantages of the present disclosure will be appreciated when considered with reference to the following description of preferred implementations and accompanying figures. The following description does not limit the disclosure; rather, the scope is defined by the appended claims and equivalents.

The present disclosure describes a client computing device, such as a head-mounted device, having a dipole antenna assembly. The dipole antenna assembly may be assembled from the preexisting components of the head-mounted device. The dipole antenna assembly includes a positive node or arm and a negative node or arm. To prevent the dipole antenna assembly and, more particularly, lines that run between the positive arm and the negative arm from shorting out, a dipole splitting region is provided between the positive node and the negative node. Chokes are provided within the dipole splitting region to limit or reduce the flow of RF current through the dipole splitting region and allow low frequency signals to pass through the dipole splitting region. In this example, a positive arm of the dipole antenna assembly may include the battery of the head-mounted device, and an arm of the dipole antenna assembly may include the primary printed circuit board ("PCB") of the system. Utilizing preexisting components within the head-mounted device reduces the cost of the structure, while also allowing for use of a dipole antenna assembly within a compact space.

Figure 1:
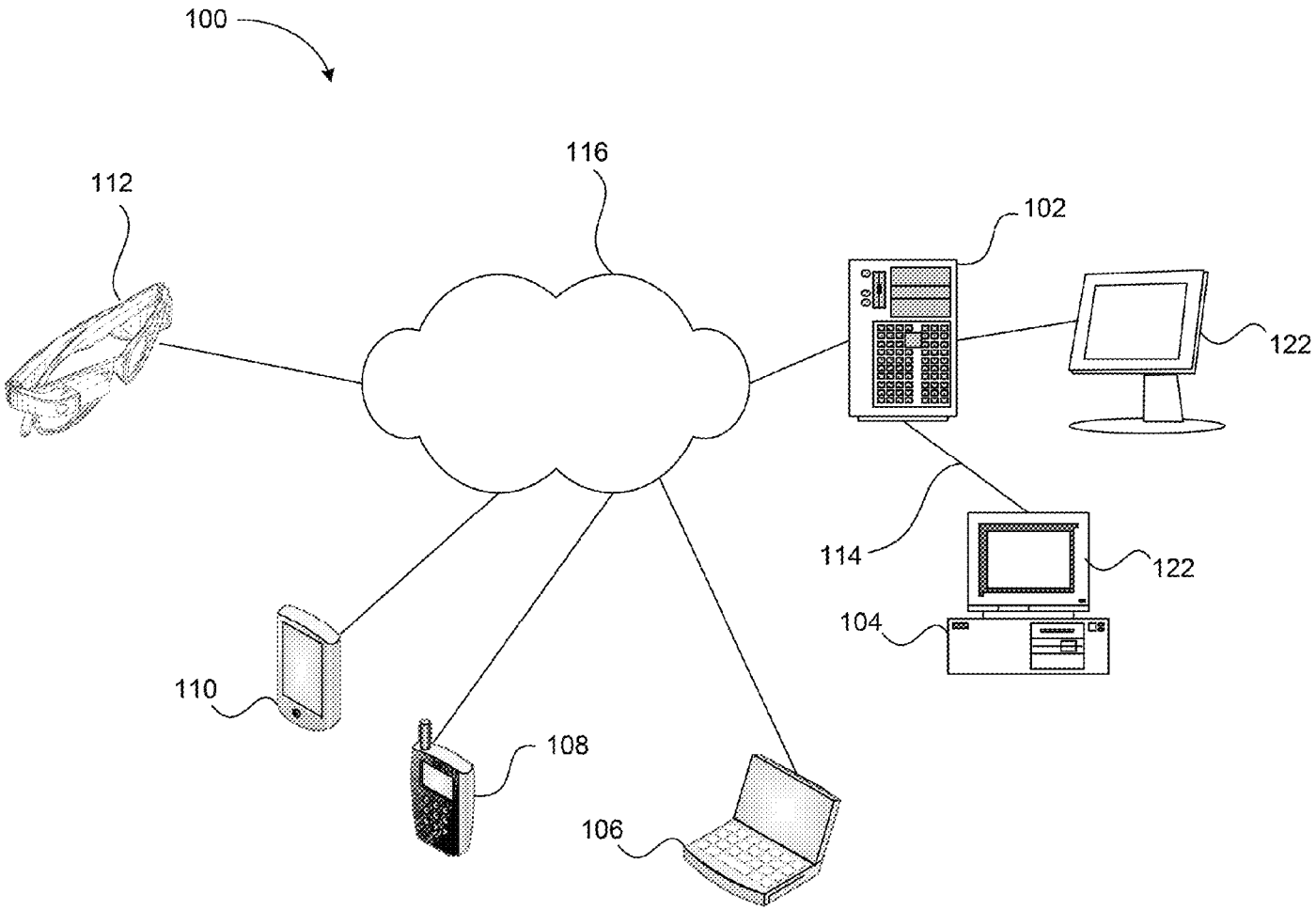
FIG. 1 is a pictorial diagram of a system in accordance with example implementations.

FIG. 1 illustrates various client computing devices that can be used alone or in a networked configuration in accordance with aspects of the disclosure. For example, FIG. 1 illustrates a network environment 100 having a plurality of client devices, including computers 102,104,106, as well as other types of devices such as a mobile phone 108, a tablet computer 110, and a head-mounted device 112. Such devices may be interconnected using a local or direct connection 114 and/or may be coupled using a network 116, such as LAN, WAN, the internet, etc., which may be wired or wireless. It is to be appreciated that network environment 100 includes example networked client devices, but in other examples, there may be a different arrangement of client devices. For example, there may be two or more head-mounted devices or other types of client devices present in the network.

Each device may include, for example, one or more processing devices and have various user inputs such as a display 122, which could include, for instance, a CRT, an LCD, a plasma screen monitor, a TV, a projector, or other inputs. Similarly, input can be provided on an exterior structure of a device, such as input provided through one of the arms of the head-mounted device or through voice-activated commands.

Figure 2:
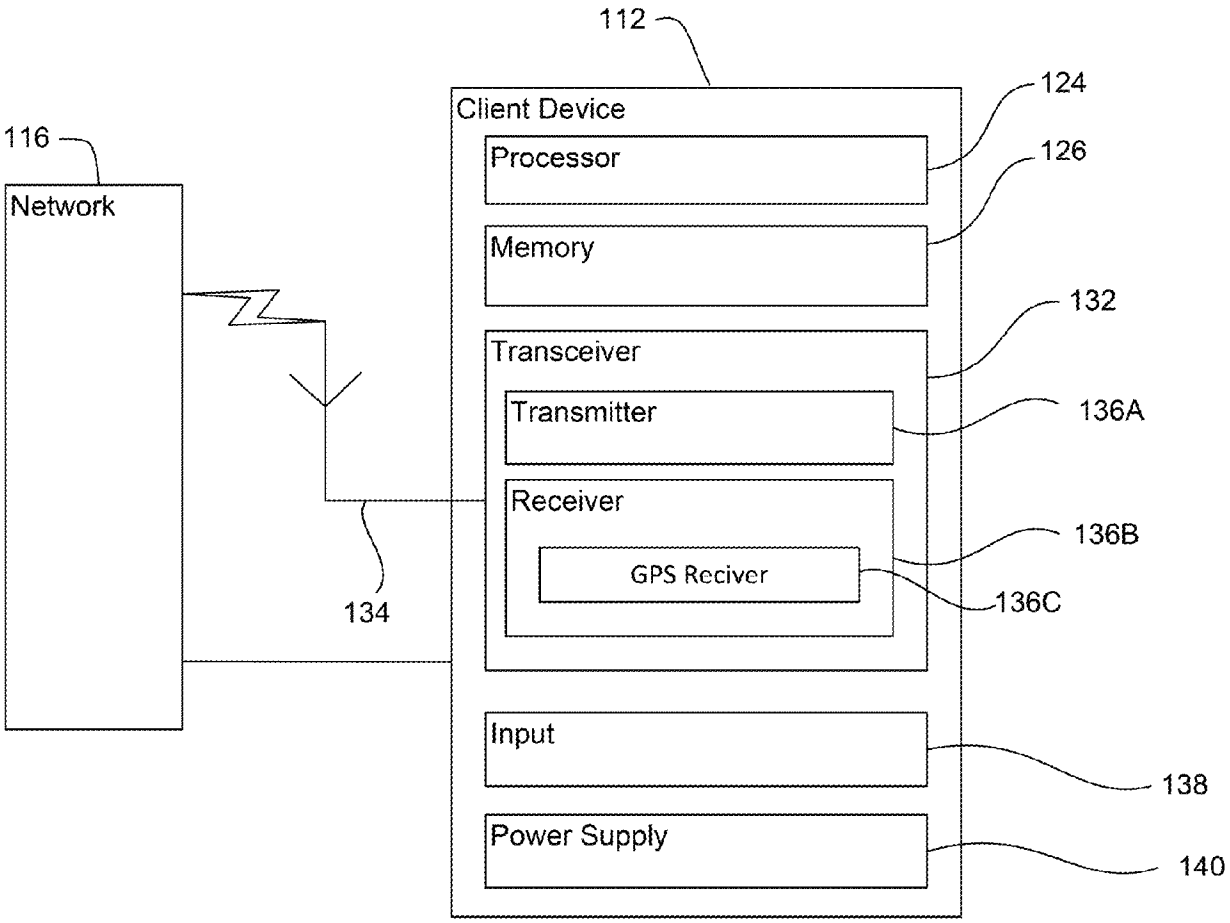
FIG. 2 is a block diagram illustrating aspects of the system of FIG. 1, including client devices incorporating dipole antenna assemblies according to aspects of the disclosure.

As shown in FIG. 2, each computer, such as client device 112, contains a processor 124, memory/storage 126 and other components typically present in a computer. For instance, memory/storage 126 stores information accessible by processor 124. The client device 112 may be a mobile computing device capable of wirelessly exchanging data. By way of example only, client device 112 may be a head-mounted device, a wireless-enabled tablet computer, a laptop computer or a cellular phone capable of obtaining information via the internet. The client device 112 may also include a transceiver 132 coupled to an antenna 134. The transceiver 132 includes a transmitter 136A and a receiver 136B for wirelessly communicating with network 116 via antenna 134.

The client device 112 may include user input 138 (e.g., controls provided on the side of the head-mounted device) or voice recognition software. The client device 112 may also include an accelerometer, speakers, a network interface device, a battery power supply 140, or other power source, and all of the components used for connecting these elements to one another.

The client devices may also include a geographic position component to determine the geographic location and orientation of the device. For example, client device 112 may include a GPS receiver 136C to determine the device's latitude, longitude, and altitude position. The client device 112 may also include software for determining the position of the device, based on other signals received by client device 112, such as signals received by the antenna of a head-mounted device from the network, if the client device is a head-mounted device. It may also include an accelerometer or gyroscope to determine the direction in which the device is oriented. By way of example only, the device may determine its pitch, yaw, or roll (or changes thereto) relative to the direction of gravity or a plane perpendicular thereto. In that regard, it will be understood that a client device's provision of location and orientation data as set forth herein may be provided automatically either to the user through an antenna, such as antenna 134, or to the server, or both.

Figure 3:
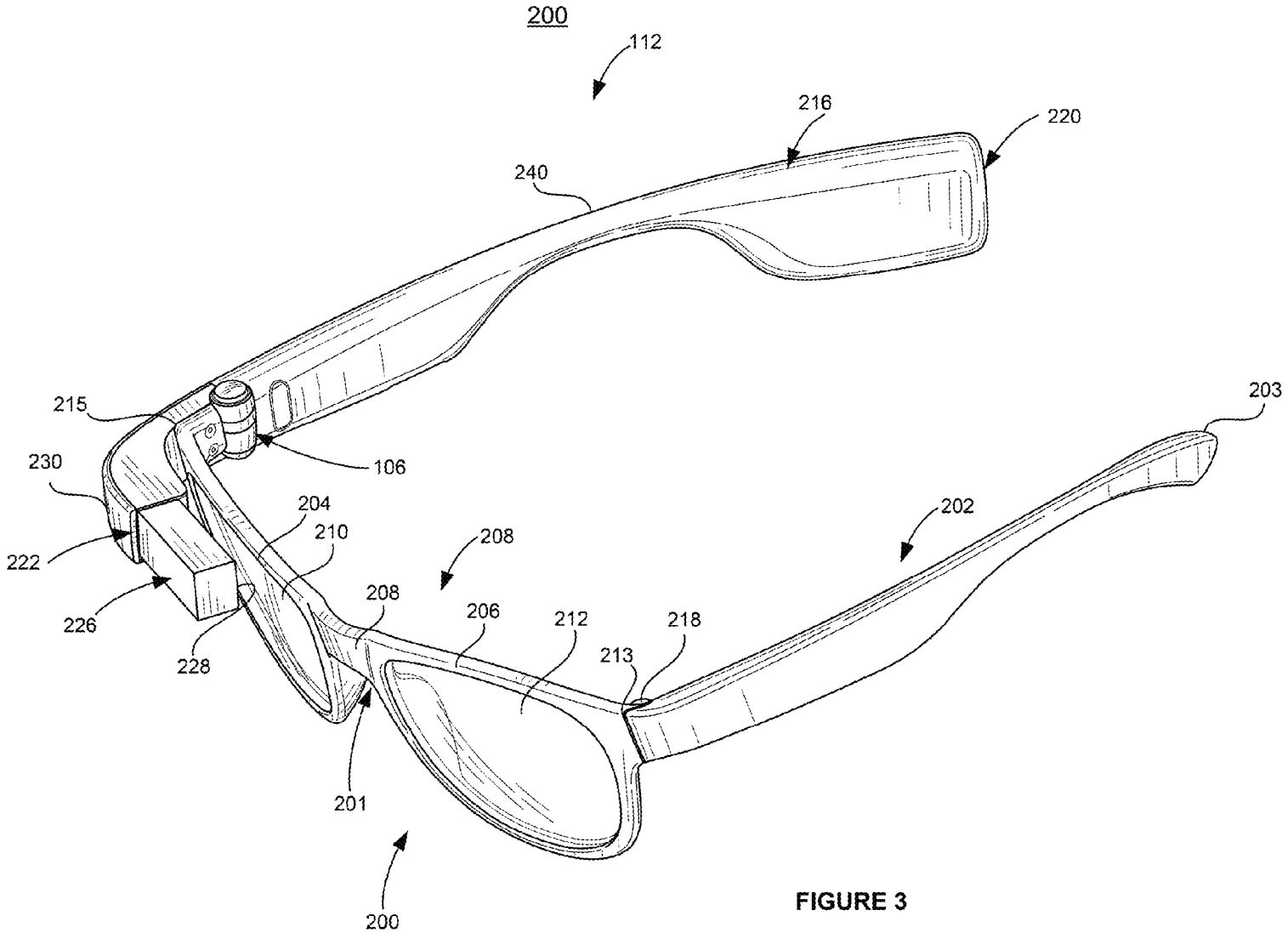
FIG. 3 illustrates a client device having a dipole antenna assembly according to aspects of the disclosure.

FIG. 3 illustrates an example of a client device that is a head-mounted device 200; however, this disclosure applies to any mobile computing device such as a tablet computer, a PDA or a cellular phone. In this example, client device 112 is a head-mounted device 200 that is capable of receiving, transmitting, and displaying data. Client device 112 is an example of a glasses-style, head-mounted device possessing an overall appearance that is similar to a conventional pair of eyeglasses or sunglasses. However, other types of head-mounted devices could additionally or alternatively be used.

The head-mounted device 200 is not limited to any one type of eyeglasses or eyewear, but can include prescription and non-prescription sunglasses, prescription and non-prescription eyeglasses, or any type of eyewear that can be used for a head-mounted device or eyewear assembly that may or may not include lenses.

The head-mounted device 200 includes several components, including lens frames 204,206, a middle frame support 208, lens elements 210,212, and a first side arm or first frame arm 202 extending away from lens frame 206. The combination of lens elements 210,212, as well as middle frame support 208 forms a unified central frame support 201. Each of the lens frames 204,206 and first frame arm 202 may be formed of a solid structure of plastic and/or metal, or may be a hollow structure of similar materials. Other materials are also contemplated within aspects of the disclosure.

The head-mounted device 200 may further include a second side arm or an optics arm 216 extending away from lens frame 206. As shown, optics arm 216 includes a first free end 220 that wraps around the front of the central frame support 201. A second free end 222 is positioned near the ear of a user (not shown). In this example, optics arm 216 houses all of the electronic components of head-mounted device 200. For example, optics arm 216 may house the electrical circuitry, battery, processors, speakers, audio, and the like, that are used to operate the device. In other examples, some of these components may be positioned in other parts of the head-mounted device, including central frame support 201 or side arm 202. The optics arm 216 may also include a light pass hole (not shown) and an imaging device 230, such as a camera, facing outward, which can capture both still and video images. The optics arm 216 may be a hollow structure comprised of plastic or other insulative materials.

A display 226 can extend from first free end 220 of optics arm 216 and may be in the form of a generally-transparent prism. The display 226 is configured to overlay or combine with the user's sight to display an image generated by electronic display components that are positioned within the outer housing of optics arm 216. Such a prism can be structured to receive a projected image and to make that image visible to a user by looking into viewing side 228 of display 226.

The optics arm 216 can secure the head-mounted device 200 to the head of a user. In this example, optics arm 216 is removably connected to opposed outer edge 215 of lens frame 204. The optics arm 216 is constructed and arranged to fit over the ear of a user to secure the head-mounted device 200 to one side of the user's head. The optics arm 216 and frame arm 202 may further secure the head-mounted device 200 to the user's head by either or both optics arm 216 and frame arm 202 extending around a rear portion of the user's head.

The head-mounted device 200 may include an onboard computing system. In one example, onboard computing system (not shown) is housed within optics arm 216. Such a computing system may include a processor and memory. The onboard computing system may be configured to receive and analyze data from imaging device 230 and/or any other device within or mounted to head-mounted device 200 or in communication with head-mounted device 200.

The head-mounted device 200 can further include an antenna assembly, which can communicate with other devices on the network and, more specifically, can receive and transmit data to and from a network. In this example, the antenna assembly is housed within outer housing 240 of optics arm 216. In other examples, the antenna may be partially housed within optics arm 216 or may, instead, be incorporated into other portions of head-mounted device 200.

Figure 4:
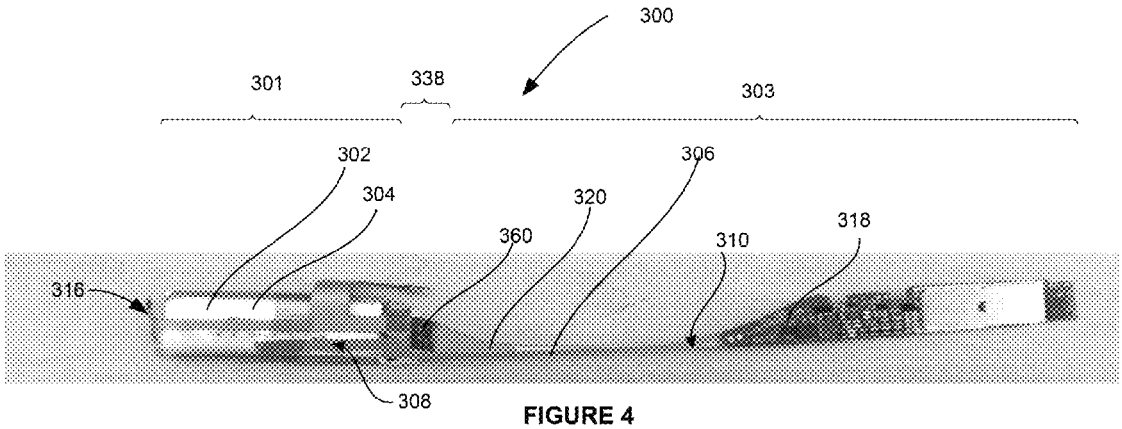
FIG. 4 illustrates an example dipole antenna assembly that can be implemented within the client device of FIG. 3.

Turning to FIG. 4, an example of an antenna assembly that can be used within a client device, such as the optics arm of the head-mounted device, is shown. In this example, the antenna is a dipole antenna assembly 300 which is capable of covering a wide array of frequencies, including GPS and WiFi. In one example, dipole antenna assembly 300 is capable of covering GPS/Global Navigation Satellite System ("GLONASS") frequencies, ranging from 1575-1605 MHz; WiFi/IBT frequencies, ranging from 2400-2484 MHz; and 5 GHz WiFi frequencies, ranging from 5150-5850 MHz. In other examples, the dipole antenna assembly may also be capable of covering cellular phone frequencies, including a UHF frequency of 1900 MHz or ranging from 800-850 MHz; 3G UHF frequencies, including a frequency of 850 MHz, or ranging from 1700-2100 MHz; and 4G UHF frequencies, including frequencies within the ranges of 700-800 MHz and 1700-2500 MHz. It is to be appreciated that the preceding frequencies are example frequencies, and a dipole antenna assembly capable of receiving and transmitting data at any frequency and for other uses is contemplated within the scope of the disclosure.

Dipole antenna assembly may have a total length that should be greater than half the wavelength at the lowest operating frequency. For example, the lowest frequency may be the frequency required for a GPS at 1.575 GHz, in which case the total length of the dipole antenna assembly is at least 3.75 inches.

Preexisting components within the head-mounted device can be used to form the positive arm 301 and the negative arm 303 of dipole antenna assembly 300. With reference still to FIG. 4, a top elevation view of the interior components of optics arm 216, which forms dipole antenna assembly 300, is shown. In this example, and as will be discussed in more detail herein, the positive arm 301 of dipole antenna assembly 300 is formed from a battery 302 with a metallic foil 304 wrapped around the battery 302; a flexible antenna 306 that has a first positive side 308 attached to battery 302; and first and second microphones of head-mounted device 200. A power button and a magnetometer positioned in top region 316 of the rear flexible component can also be included as part of the positive arm 301 of head-mounted device 200.

When a first positive side 308 of flexible antenna 306 is attached to battery 302, flexible antenna 306 is directly adjacent battery 302. Due to capacitive coupling, battery 302 forms a primary part of the positive arm 301 of dipole antenna assembly 300. The negative arm 303 of dipole antenna assembly 300 can be formed from the primary PCB 318, a second negative side 310 of flexible antenna 306 that is attached to the PCB 318, the ground of a rear flexible component 320 that is attached to flexible antenna 306, and a speaker (not shown in this view). Additional details regarding some of these components, such as battery 302, flexible antenna 306, and rear flexible component 320 will be discussed in further detail herein.

The chokes 360 are positioned between the positive arm 301 and the negative arm 303 of dipole antenna assembly 300. As will be discussed in more detail herein, chokes 360 are provided within a dipole splitting region 338 to prevent power and signal lines that extend in the area between battery 302 and PCB 318 from short circuiting.

It is to be appreciated that dipole antenna assembly 300 does not need to be symmetric, nor does the positive arm 301 and negative arm 303 have to be symmetric or the same size.

Figure 5:
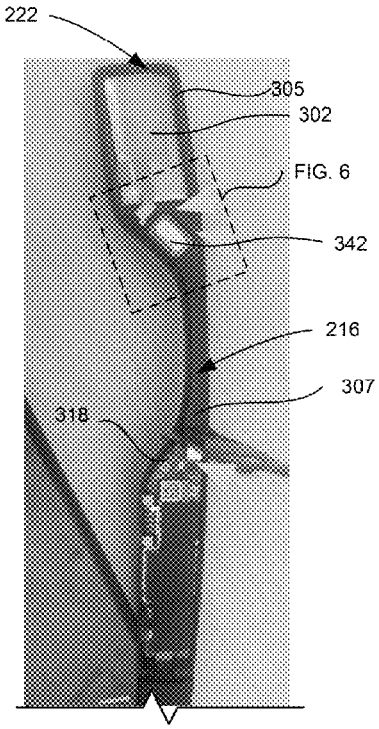
FIG. 5 illustrates the example dipole antenna assembly of FIG. 4 within an example optics arm or side arm of the client device of FIG. 3.

FIG. 5 illustrates dipole antenna assembly 300 positioned within optics arm 216 of the head-mounted device. As shown, battery 302 is positioned adjacent second free end 222 of the optics arm, and PCB 318 is positioned between the first free end (not shown) of optics arm 216 and second free end 222. As shown, first outer housing 305 is a substantially hollow housing. In this example, all of the components of dipole antenna assembly 300 fit into outer housing 305 of optics arm 216 and are completely housed within optics arm 216. In other examples, one or more portions of dipole antenna assembly 300 may extend into other portions of the head-mounted device such as the central frame support or the other side arm of the head-mounted device. A second intermediate housing 307 may be planar and can be used to cover or protect portions of the dipole antenna assembly. For purposes of illustration, second intermediate housing 307 is shown extending upward, but when the optics arm is fully assembled, second intermediate housing 307 lays flat and overlies the PCB.

It is to be appreciated that battery 302 directly overlies outer housing 305, which, in this example, is comprised of a plastic or insulative material. The position of battery 302 within the plastic material of outer housing 305 insulates battery 302 and allows battery 302 to operate as an antenna without interference from other signals. This is due, in part, to the fact that battery 302 is not positioned on a metal plane, which is common in other compact client devices that utilize metal housings or require the battery to be adjacent a metal plane, such as cellular phones, PDAs, and the like. Positioning the dipole antenna assembly near a solid metal surface can make it more challenging for the dipole antenna to efficiently radiate.

Figure 6:
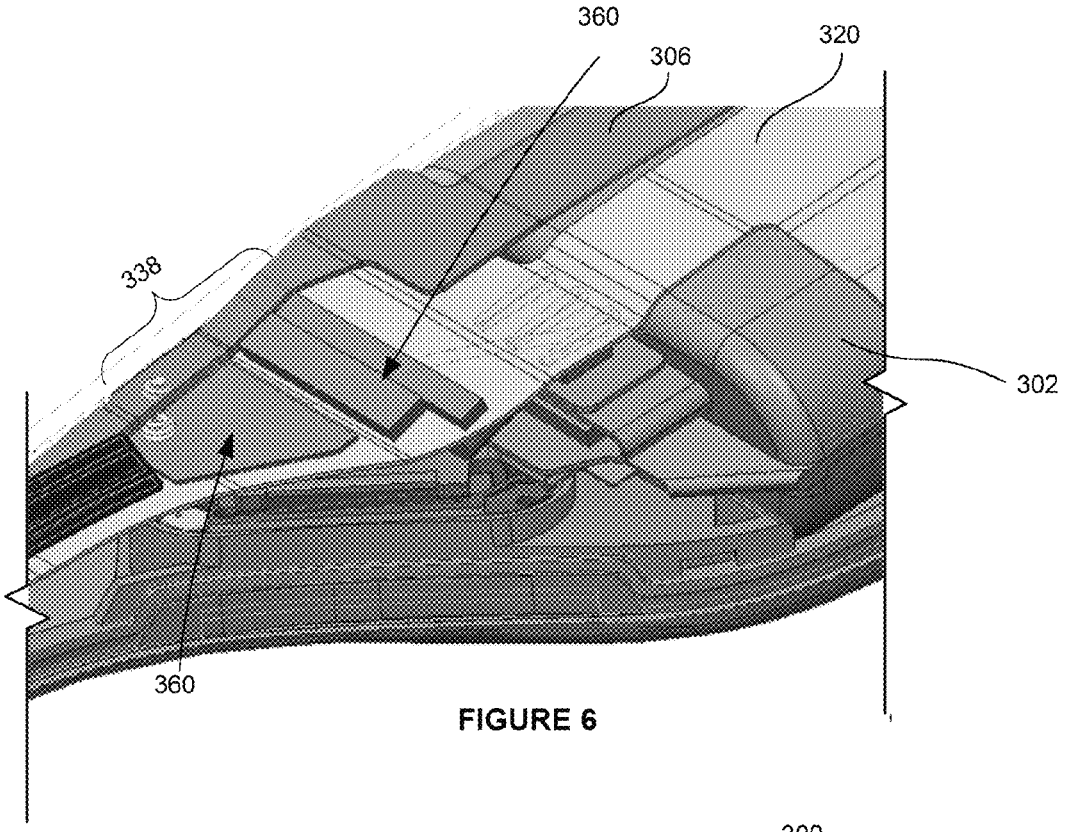
FIG. 6 illustrates an example internal arrangement of components in the example dipole antenna assembly.

FIG. 6 provides an enlarged perspective view of the area of the dipole antenna assembly at the dipole splitting region 338 without the overlying second intermediate housing 307. As shown in this example, rear flexible component 320 supports at least a portion of flexible antenna 306, as well as chokes 360. The flexible antenna 306 and rear flexible component 320 are both shown having respective rear portions wrapping around battery 302.

Figure 7:
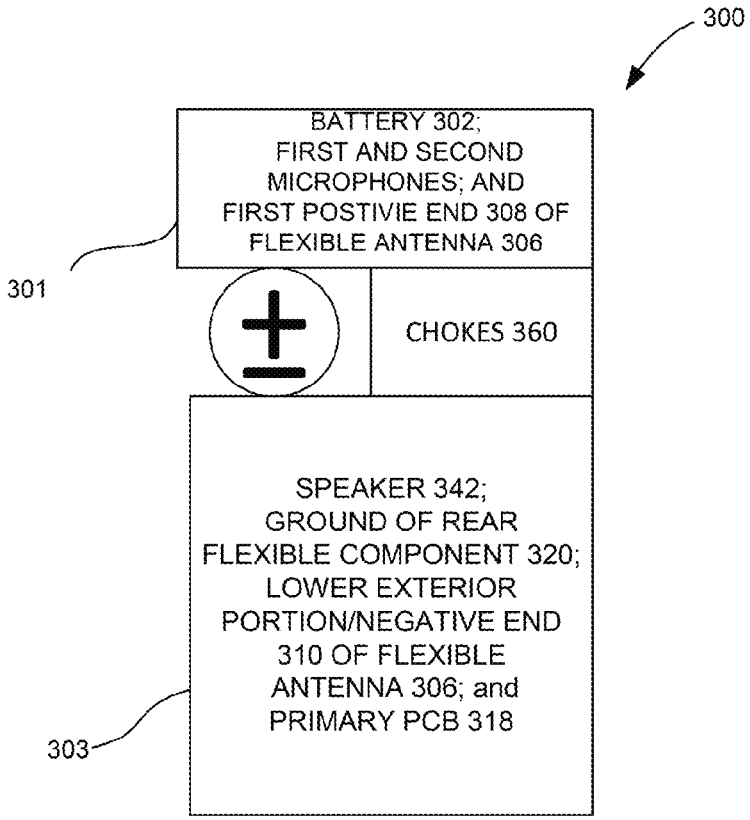
FIG. 7 is an example schematic diagram showing the components of the dipole antenna assembly forming the positive and negative arms of the dipole antenna assembly according to aspects of the disclosure.

FIG. 7 is a schematic diagram of the dipole antenna assembly according to the previously described example. The dipole antenna assembly 300 includes a positive arm 301 and a negative arm 303. As shown in this example and previously described herein, the positive arm 301 of dipole antenna assembly may include battery 302, a first microphone, a second microphone 314, and the top portion or positive side of flexible antenna 306. The portion of rear flexible component attached to battery 302 may also form a part of the positive arm 301 of dipole antenna assembly. The negative arm 303 of the dipole antenna assembly may include speaker 342, the exterior surface of the lower portion of flexible antenna 306, and the ground of rear flexible component 320. Chokes 360 are positioned between the positive arm 301 and the negative arm 303 of dipole antenna assembly 300.

In this example, the positive and negative arms 301,303 of dipole antenna assembly 300 are formed from the components of dipole antenna assembly 300 that are positioned between battery 302 and primary PCB 318. Battery 302 and primary PCB 318 form the outermost ends of the dipole antenna assembly and are connected together through flexible antenna 306 and rear flexible component 320. Battery 302 generates a current and forms the positive end of the dipole antenna assembly; primary PCB 318 or another component forms the negative side of dipole antenna assembly; and an intermediate component, such as rear flexible component or flexible antenna, connects the battery and primary PCB together and provides a transmission line. Other components, such as the speaker magnetometer, that extend along the intermediate component, can be incorporated into either the positive or negative sides of the dipole antenna assembly.

In other examples, fewer components or different components of a device may be used to form the dipole antenna assembly. For example, speakers, microphone, power buttons, and the like, may be positioned in other parts of the head-mounted device, or some of them may not be included as part of the head-mounted device. The possibilities are therefore numerous as to what components can form a dipole antenna assembly. In this regard, the components forming part of the dipole antenna assembly may vary depending on the design of a particular device and the particular components required for the device.

Figure 8:
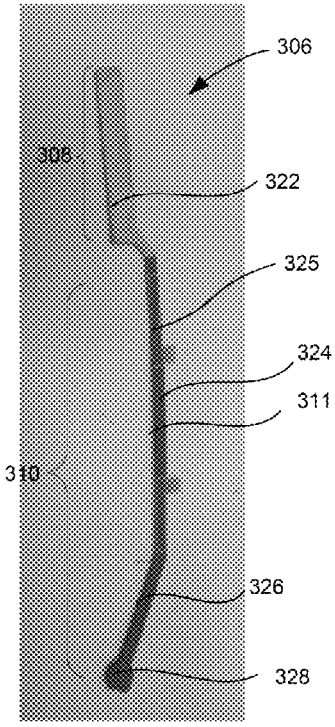
FIG. 8 is an example flexible antenna according to aspects of the disclosure.

Several components that form dipole antenna assembly 300, as well as the assembly of these components, are now discussed in greater detail. Turning first to FIG. 8, a top elevation view of the first surface of flexible antenna 306 is shown. In one example, flexible antenna 306 extends in a longitudinal direction along a substantial length of the optics arm. The flexible antenna 306 includes a first positive side 308 and a second negative side 310. The flexible antenna 306 may be comprised of a thin metal, such as copper, galvanized steel, or aluminum. The flexible antenna 306 will also extend between the positive dipole side and the negative dipole side of the overall dipole antenna assembly 300. Although in this embodiment, flexible antenna 306 is formed from a flexible material, in other examples, antenna 306 may be rigid, and not flexible, or otherwise include portions that are rigid. The first positive side 308 of flexible antenna 306 may be elongated or rectangular-shaped. Outer surface 322 of first positive side 308 may be an exposed metal area.

The second negative side 310 of flexible antenna 306 is elongated and extends in a direction away from the first positive side 308 of flexible antenna 306. The interior (not shown) of the second negative side 310 forms the transmission line 324. The outer surface 325 of transmission line 324 forms part of the second negative side 310 of the dipole antenna assembly. RF current will be capable of independently flowing on the interior and exterior surfaces of the transmission line. The flexible antenna 306 includes an end 328 of second negative side 310. The end 328 can attach to the primary PCB through contacts (not shown in this view).

Figure 9A:
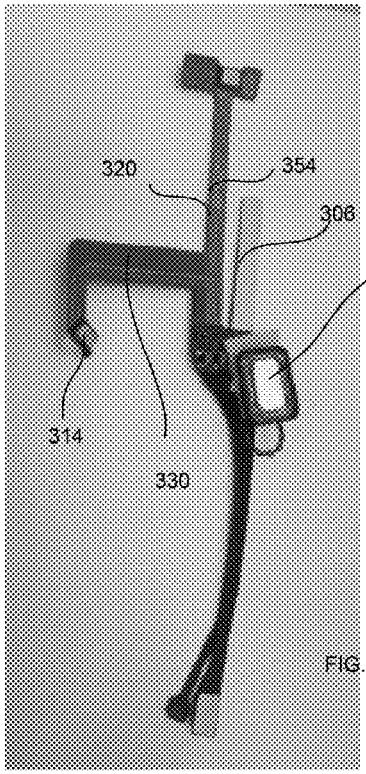
FIG. 9A illustrates one side of an example rear flexible component joined together with the example flexible antenna according to aspects of the disclosure.

A rear flexible component 320 can be used to support flexible antenna 306. With reference to FIG. 9A, there is shown a top view of the top surface 330 of rear flexible component 320 joined together with flexible antenna 306. This view shows assembly of these two components prior to assembly with other components of the dipole antenna assembly. The rear flexible component 320 can be comprised of an elongated piece of metal, such as copper, aluminum, or galvanized steel. In this view, rear flexible component 320 is shown overlying flexible antenna 306. The rear flexible component 320 may be flexible in this example but, in other examples, component 320 may be rigid or include portions that are rigid.

Figure 9B:
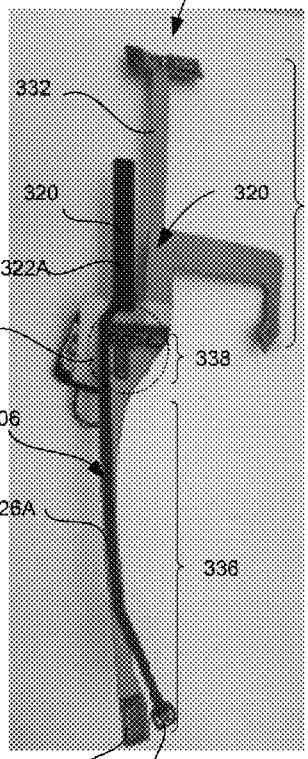
FIG. 9B illustrates another side of the example rear flexible component of FIG. 9A joined together with the example flexible antenna according to aspects of the disclosure.

FIG. 9B illustrates a bottom surface 332 of rear flexible component 320, and respective bottom surfaces 322A,326A of the first positive side 308 and second negative side 310 of flexible antenna 306. Flexible antenna 306 can be attached to rear flexible component 320 using a conductive adhesive (not shown) that allows for flexible antenna 306 to ground itself to rear flexible component 320.

The rear flexible component 320 can also be used to support and/or electrically connect several components of the head-mounted device and, more particularly, those components that may be found in the optics arm. For example, in a top region 316 of rear flexible component 320, rear flexible component 320 supports a first microphone, a magnetometer, and a power button. The rear flexible component 320 can also support additional components, such as speaker 342, a second microphone 314 (FIG. 9A), an LED, battery lines that deliver power to the main PCB, signal lines for the fuel gauge, and a battery ID resistor. The traces 354 (FIG. 9A) are shown extending along the top surface 330 of rear flexible component 320 that communicate with the different components within the head-mounted device. It is to be appreciated that the components supported by rear flexible component 320 are exemplary, and that rear flexible component can support any number of components required for the particular design of a client device, such as a head-mounted device.

The rear flexible component 320 includes a first positive side 334, a second negative side 336, and the dipole splitting region 338 that separates the first positive side 334 and the second negative side 336. The first positive side 308 of flexible antenna 306 extends away from a primary portion of rear flexible component 320. Second negative side 310 or lower portion of flexible antenna 306 is adjacent to a substantial length of the lower portion or second negative side 336 of rear flexible component 320. For example, flexible antenna 306 may extend along the lower length of rear flexible component 320. Contacts 340 of flexible antenna 306 are exposed and extend outward and away from rear flexible component 320. Contacts 340 can be used to join flexible antenna 306 to the PCB.

The dipole splitting region 338 is shown positioned between the first positive side 334 and second negative side 336 of rear flexible component 320. As shown, dipole splitting region 338 separates and is positioned between first positive side 334 and second negative side 336 of rear flexible component 320. Additionally, as previously discussed, dipole splitting region separates the positive arm and the negative arm of the overall dipole antenna assembly. At least a portion of dipole splitting region 338 extends across the entire width W of rear flexible component 320.

Figure 10A:
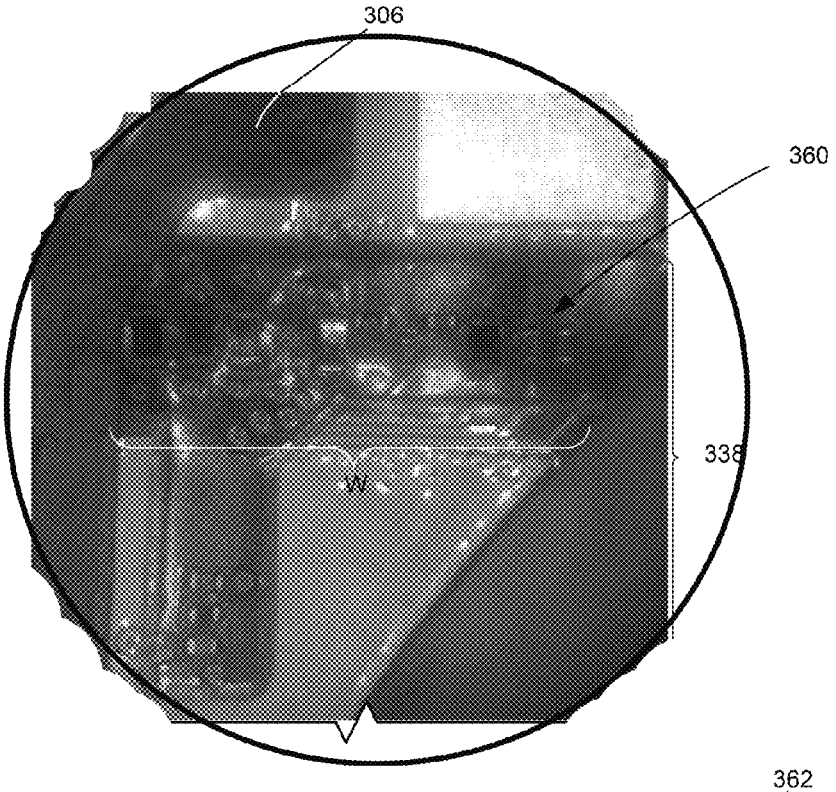
FIGS. 10A-10B are enlarged views of a portion of FIG. 9B.
Figure 10B:
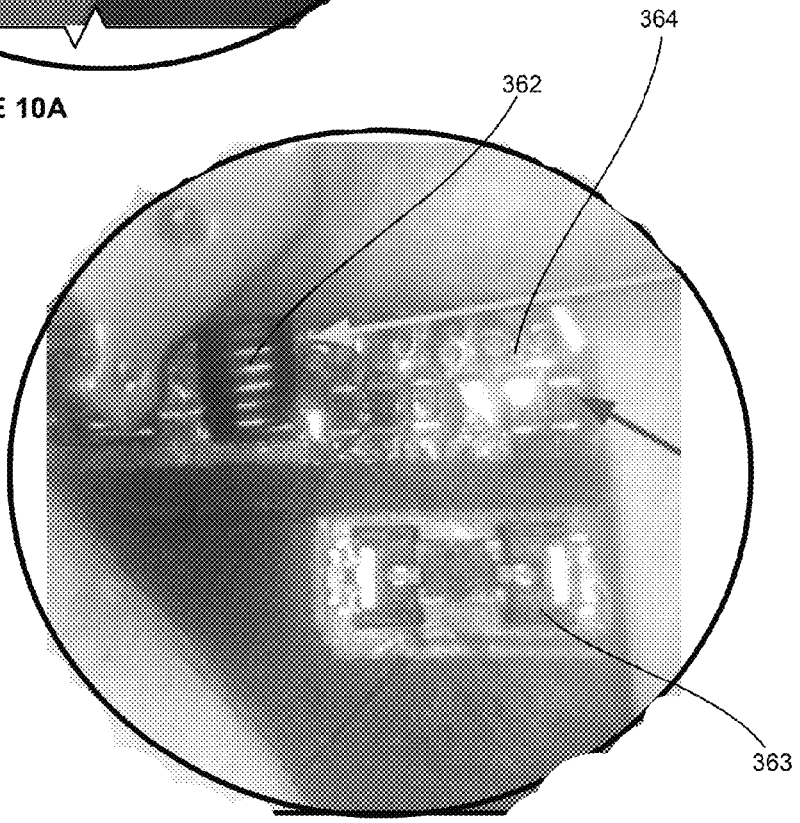

In this example, all chokes within dipole antenna assembly are positioned within dipole splitting region 338. With reference to FIGS. 10A-10B, chokes are shown at the junction between the positive and negative arms of the dipole antenna assembly. Chokes may be embedded within silicon, plastic, glass, or any other type of material within or adjacent rear flexible component 320.

Figure 11:
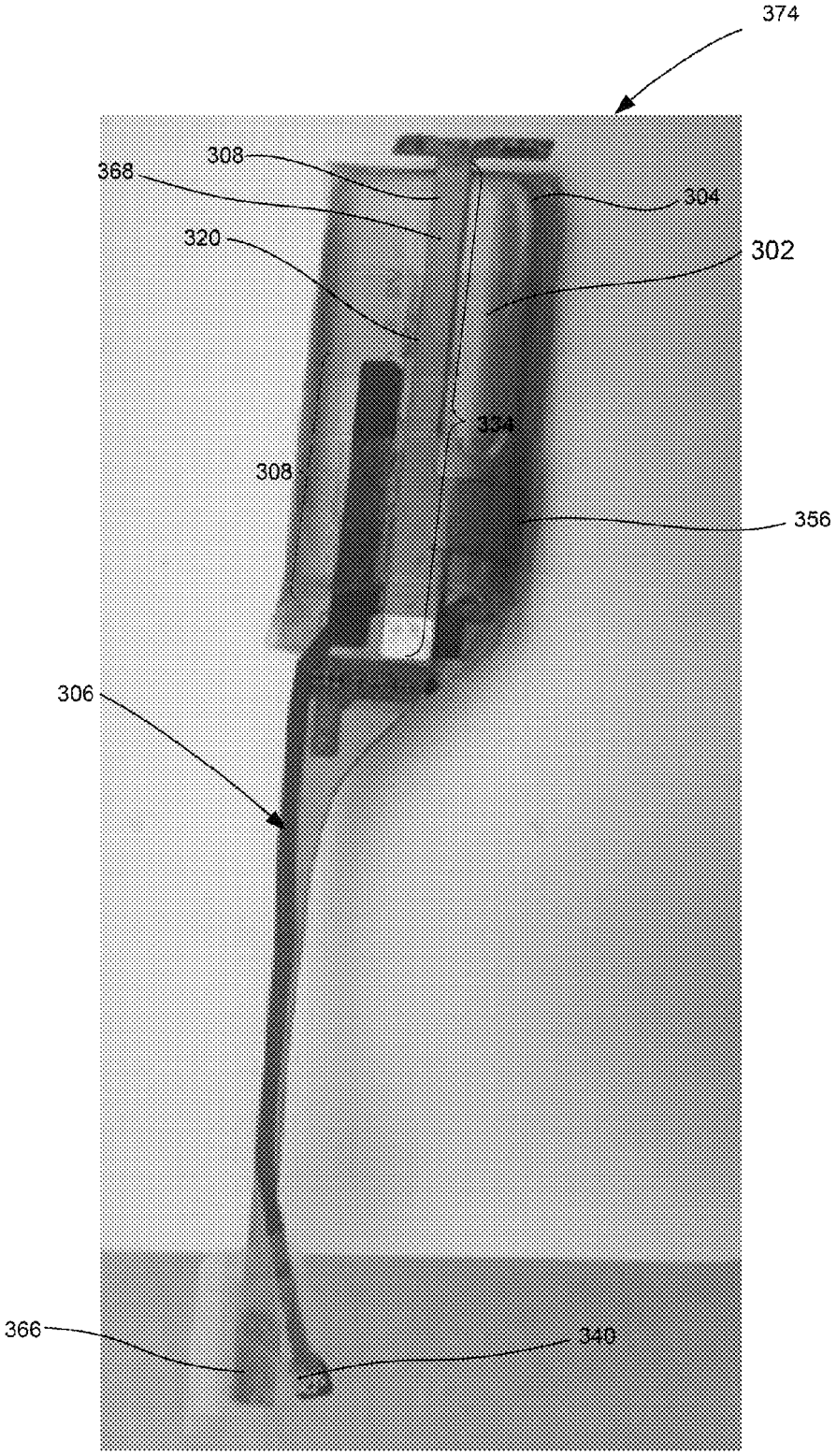
FIG. 11 shows the rear flexible component and the flexible antenna joined with a battery.

FIG. 11 illustrates flexible antenna 306 and rear flexible component 320 joined together with battery 302 to form a subassembly 374. Battery 302 may be any standard battery that can be utilized to power a head-mounted device. For example, battery 302 may be a 2.1 Wh (570 mAh) single-cell lithium polymer unit. As shown, battery 302 may be wrapped in a metallic foil 304. Use of metallic foil 304 permits battery 302 to carry or conduct radio frequencies, signals, and the like. This allows for battery 302 to act as a conductor. Examples of metallic foil 304 may include copper foils, aluminum foils, or other metallic foils. In another embodiment, battery 302 can be coated with a metallic material to serve as a conductive layer. For example, a metallic material may be plated onto the surface of battery 302.

Outer surface (not shown) of first positive side 308 of flexible antenna 306 faces and attaches to metallic foil 304 and battery 302. Flexible antenna 306 may be attached to battery 302 using known methods. For example, flexible antenna 306 may be taped to battery 302 or attached using a conductive adhesive or epoxy. Due to capacitive coupling, the battery forms part of the positive arm 301 of dipole antenna assembly 300.

The first positive side 334 of rear flexible component 320 attaches to metallic foil 304 of battery 302. Rear flexible component 320 may be attached to metallic foil 304 using known methods, such as tape. The arm 356 of rear flexible component 320 wraps around metallic foil 304 and a side of battery 302. The arm 368 wraps around the top of battery 302. Rear flexible component 320 can also be directly attached to battery 302. The same type of capacitive coupling also takes effect when rear flexible component 320 is attached to metallic foil 304 of battery 302. When joined to the battery, rear flexible component 320 and all associated signals are coupled to battery 302.

The contacts 340 of flexible antenna 306 and contacts 366 of rear flexible component 320 may then be attached to the primary PCB 318, as shown in FIGS. 4-5, to form a completed dipole antenna assembly.

With reference still to the completed dipole antenna assembly shown in FIGS. 4-5, terminals (not shown) of battery 302 may be directly connected to primary PCB 318 through flexible antenna 306 and rear flexible component 320. Terminals of battery 302 define the location where the dipole antenna assembly divides into a positive arm or a negative arm. To prevent the positive arm 301 and the negative arm 303 of dipole antenna assembly 300 from shorting out in the area of the battery terminals, the positive and negative arms 301,303 of dipole antenna assembly 300 must remain independent. Any lines that cross from the positive arm 301 to the negative arm 303 pass through chokes 360 in the dipole splitting region 338, including inductors, resistors, and the like.

In this example, chokes 360 can extend in an area of dipole antenna assembly 300 between the first positive side and the second negative side of the rear flexible component 320 (which is also between and separates the positive arm and the negative arm of dipole antenna assembly 300) to prevent lines, such as power lines and signal lines, from short circuiting. Such lines, extending in the area between battery 302 and the circuit board, cross through chokes 360 in dipole splitting region 338. For example, power lines (not shown), speaker lines (not shown), signal lines (not shown), and any necessary lines that extend between the positive arm 301 and the negative arm 303, travel through chokes 360. For example, battery lines can pass through power line chokes 362, other signal lines can pass through the inductors 364, and still other lines may pass through resistors 363. In this example, all of these lines may be positioned on the rear flexible component. It is to be appreciated that the lines can be positioned anywhere on the rear flexible component but, in this example, lines crossing between the negative and positive dipole arms pass through chokes 360.

Inductors are chokes that have a low or zero impedance at low frequencies, but high impedance at RF frequencies. The inductors allow low frequency signals to flow through the dipole splitting region without the dipole antenna assembly shorting out. For example, with reference to FIG. 10B, which illustrates a rear view of FIG. 10A, power line chokes 362, inductors 364, and resistors 363 can be provided within the dipole splitting region 338. Power line choke 362 interferes with the battery lines (not shown) that will extend between the positive and negative arms of the dipole antenna assembly. An example of a choke may include a 0806SQ air core inductor (~19 nH) to choke off the RF current. This enables DC/low frequency signals to pass from the battery to the primary PCB, while presenting a high impedance at RF frequencies. This also ensures a clear separation between the two arms of the dipole antenna assembly and ensures that everything crossing the line between the battery and the main PCB are tightly controlled. In such example, low frequency signals, such as those signals from the microphone, power button, and other components in the dipole antenna assembly, can pass through the dipole splitting region without short-circuiting the dipole antenna assembly.

Figure 12:
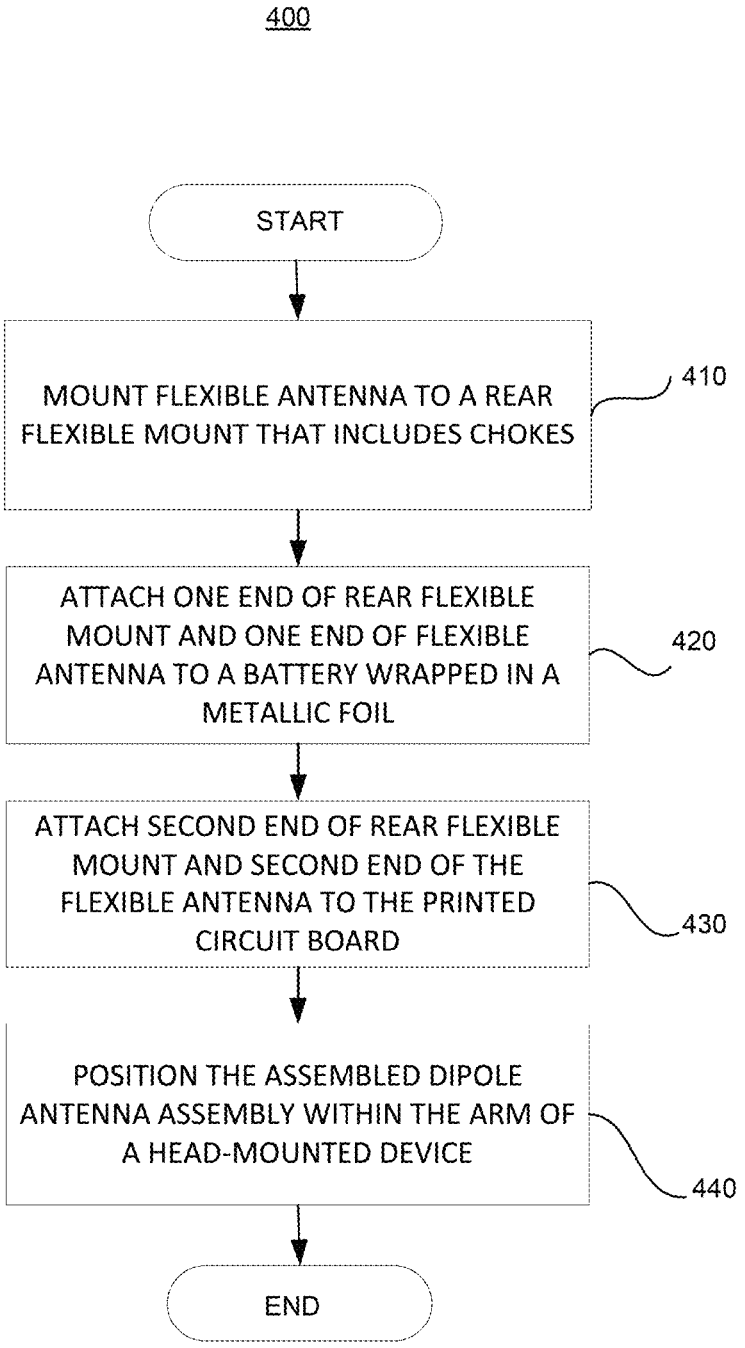
FIG. 12 illustrates a method for providing a dipole antenna assembly in a client device.

FIG. 12 illustrates a method 400 for providing a dipole antenna assembly in a client device. The method begins by mounting a rear flexible antenna to a rear flexible mount or component having chokes thereon. The flexible antenna may be comprised of an elongated flexible metal, and a conductive adhesive may be used to both attach and ground the flexible antenna with the rear flexible mount. A portion of the flexible antenna may operate as a transmitter, as shown and described in more detail in FIG. 8. The rear flexible mount may include electronic components of the client computing device provided thereon, as shown and described in more detail in FIGS. 9A-9B. Electronic components may include chokes, power lines, signal lines, a speaker, and other components of the client computing device.

At block 420, a first portion of the rear flexible mount and a first portion of the flexible antenna may be attached to a battery wrapped in a metallic foil. Attaching the rear flexible mount and the flexible antenna to the battery capacitively couples both rear flexible mount and flexible antenna and all associated signals directly to the battery. The battery can form a positive arm of the dipole antenna assembly.

At block 430, a second portion of the rear flexible mount and a second portion of the flexible antenna are attached to a printed circuit board. The printed circuit board, the ground of the rear flexible mount, and a portion of the flexible antenna may form a negative arm of the dipole antenna assembly.

At block 440, the components of the dipole antenna assembly may be provided in the housing of the client computing device. For example, the dipole antenna assembly may be encased within an arm of a glasses-style head-mounted device, as shown in FIGS. 3-5.

While certain processes in accordance with example implementations are shown in the figures as occurring in a linear fashion, this is not a requirement unless expressly stated herein. Different processes may be performed in a different order or concurrently.

The example embodiments described herein are not meant to be limiting. It will be readily understood that the aspects of the present disclosure, as generally described herein and illustrated in the figures, can be arranged, substituted, combined, separated, and designed in a wide variety of different configurations, all of which are explicitly contemplated herein.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "in this example," "for example," "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A dipole antenna assembly for an electronic device comprising:

a rear mount having first and second ends and electronic components exposed at a surface thereof;

an antenna adjacent the rear mount, the antenna including a first end adjacent portion of the antenna and a second end adjacent a second portion of the antenna, the second portion comprising a transmission line;

a printed circuit board joined to the second end of the antenna and the second end of the rear mount;

a battery connected to and positioned adjacent the first end of the rear mount and the first end of the antenna, the battery electrically connected to the printed circuit board;

a positive arm comprising the battery and the first end of the antenna;

a negative arm comprising the printed circuit board, the second end of the antenna, and the transmission line; and a dipole splitting region separating the positive arm and the negative arm, the dipole splitting region including a plurality of chokes, wherein the antenna continuously extends between the positive arm and the negative arm and conductively connects the battery and printed circuit board together.

2. The dipole antenna assembly of claim 1, wherein the plurality of chokes inhibit a flow of RF current between the positive arm and the negative arm of the dipole antenna assembly as a low frequency current passes through the dipole splitting region.

3. The dipole antenna assembly of claim 2, wherein at least one of the plurality of chokes comprises one of an inductor and a resistor.

4. The dipole antenna assembly of claim 1, wherein the electronic components further comprise at least one of a magnetometer, a microphone, a speaker, a power button, a light emitting diode, signal lines for the fuel gauge, and a battery ID resistor.

5. The dipole antenna assembly of claim 1, wherein the electronic device is a head-mounted device, the head-mounted device further comprising a central eyeglass frame; a first side arm extending away from a first end of the central eyeglass frame and housing an optics display for displaying images to a user; and a second side arm extending away from an opposed second end of the central eyeglass frame, the dipole antenna assembly being positioned within the head-mounted device.

6. The dipole antenna assembly of claim 5, wherein the dipole antenna assembly is positioned within the first side arm of the head-mounted device.

7. The dipole antenna assembly of claim 1, wherein the antenna is attached to the battery.

8. The dipole antenna assembly of claim 1, wherein the antenna and rear mount are flexible.

9. A dipole antenna assembly for an electronic device comprising:

an antenna having a first portion and a second portion;

a battery joined to the first portion;

a printed circuit board joined to the second portion; and chokes constructed and arranged to impede a flow of RF current within the dipole antenna assembly, wherein the flow of RF current flows across an area of the dipole antenna assembly extending between the battery and printed circuit board, wherein the antenna continuously extends between the battery and the printed circuit board and conductively connects the battery and the printed circuit board together.

10. The dipole antenna assembly of claim 9, wherein the battery forms a positive dipole, the second portion of the antenna and the printed circuit board form a negative dipole, and a split region separates the positive dipole from the negative dipole, the chokes being positioned within the split region.

11. The dipole antenna assembly of claim 9, wherein the dipole antenna assembly covers a range of frequencies, the range of frequencies selected from at least one of (a) 1575-1605 MHz; (b) 2400-2484 MHz; and (c) 5150-5850 MHz.

12. The dipole antenna assembly of claim 9, wherein the antenna is an elongated and flexible metallic element, the second portion of the antenna comprising a transmission line.

13. The dipole antenna assembly of claim 12, wherein a positive dipole is formed from the first portion of the antenna and the battery, and a negative dipole is formed from an exterior surface of the second portion of the antenna.

14. The dipole antenna assembly of claim 13, wherein the negative dipole further comprises a rear component, the rear component supporting the flexible antenna.

15. The dipole antenna assembly of claim 9, wherein the electronic device is a head-mounted device, the head-mounted device further comprising a central eyeglass frame; a first side arm extending away from a first end of the central eyeglass frame and housing an optics display for displaying images to a user; and a second side arm extending away from an opposed second end of the central eyeglass frame, the dipole antenna assembly being positioned within the first side arm.

16. The dipole antenna assembly of claim 9, wherein the chokes are disposed on a rear mount, the battery being conductively connected to the antenna and a first end of the rear mount; the printed circuit board being conductively connected to the antenna and a second end of the rear mount.

17. A head mounted device, the head-mounted device comprising:

a central eyeglass frame;

a first side arm extending away from a first end of the central eyeglass frame;

a display connected to the first side arm and providing images to a user; and a dipole antenna assembly positioned within the first side arm, the dipole antenna assembly further comprising:

a battery forming a positive arm of the dipole assembly;

another component of the head-mounted device forming a negative arm of the dipole antenna assembly;

a split region separating the positive side and the negative side of the dipole antenna assembly and chokes positioned within the split region; and an antenna continuously extending between the battery and the another component and conductively connecting the battery and the another component together.

18. The head mounted device of claim 17, wherein the another component is a printed circuit board.

19. The head mounted device of claim 17, wherein the dipole antenna assembly further comprises a split region separating the positive arm and the negative arm of the dipole antenna assembly and chokes positioned within the split region.

* * * * *